US006288353B1

(12) United States Patent
Chiang

(10) Patent No.: US 6,288,353 B1
(45) Date of Patent: Sep. 11, 2001

(54) COMPUTER KEYSWITCH WITH ACCURATELY POSITIONED RUBBER DOMES

(75) Inventor: Chih-Hsiang Chiang, Chung-Li (TW)

(73) Assignee: Acer Communications and Multimedia Inc., Taoyuan (TW)

( * ) Notice: Subject to any disclaimer, the term of this patent is extended or adjusted under 35 U.S.C. 154(b) by 0 days.

(21) Appl. No.: 09/562,119

(22) Filed: May 1, 2000

(30) Foreign Application Priority Data

May 13, 1999 (TW) ..... 88107794

(51) Int. Cl.[7] ..... H01H 13/70
(52) U.S. Cl. ..... 200/512; 200/517; 200/344
(58) Field of Search ..... 200/5 A, 512, 200/517, 341, 344, 345; 400/490, 491, 491.2, 495, 495.1, 496

(56) References Cited

U.S. PATENT DOCUMENTS 5,500,497 * 3/1996 Merriman ..... 200/512
5,850,194 * 12/1998 Lin ..... 341/22
5,950,810 * 9/1999 Pan et al. ..... 200/344
5,952,629 * 9/1999 Yoshinaga et al. ..... 200/5 A
6,040,541 * 3/2000 Li ..... 200/344
6,057,522 * 5/2000 Chao ..... 200/344

* cited by examiner

*Primary Examiner*—Michael Friedhofer
(74) *Attorney, Agent, or Firm*—Winston Hsu

(57) ABSTRACT

A computer keyswitch with accurately positioned rubber domes. The computer keyswitch includes a base plate, a membrane circuit board installed on the base plate, and a rubber sheet positioned on the membrane circuit board. The membrane circuit board has a plurality of pressure sensors. The rubber sheet has a plurality of upwardly protruding rubber domes each above a corresponding pressure sensor, and a plurality of rubber pegs around each of the rubber domes. The base plate and the membrane circuit board have a plurality of fastening holes positioned corresponding to the rubber pegs. The rubber pegs will engage with the fastening holes to accurately position the rubber domes of the rubber sheet on the pressure sensors of the membrane circuit board.

18 Claims, 11 Drawing Sheets

COMPUTER KEYSWITCH WITH ACCURATELY POSITIONED RUBBER DOMES

BACKGROUND OF THE INVENTION

1. Field of the Invention

The present invention relates to a computer keyswitch, and more particularly, to a computer keyswitch with accurately positioned rubber domes.

2. Description of the Prior Art

A computer keyswitch is a common input device. It comprises a base plate, a membrane circuit board installed on the base plate having a plurality of pressure sensors, a plurality of upwardly protruding rubber domes each on a pressure sensor of the membrane circuit board, and a plurality of keycaps each on a rubber dome. Each of the rubber domes is used to elastically support a corresponding keycap. When the keycap is depressed, the rubber dome will trigger the pressure sensor underneath to generate a key-pressing signal. There are two types of rubber domes. Rubber domes of the first type are monolithically formed on a rubber sheet. These rubber domes are automatically positioned on corresponding pressure sensors when the rubber sheet is placed on the membrane circuit board. Rubber domes of the second type are of a stand-alone type. They are individually positioned on the pressure sensors of the membrane circuit board. Nowadays, research is focused on reducing the thickness and weight of the keyswitch. Moreover, means for improving the positioning precision of the rubber domes on the pressure sensors is also strongly considered.

Please refer to FIGS. 1 and 2. FIG. 1 is a component diagram of a keyswitch 13 of a computer keyswitch. FIG. 2 is a cross-sectional view of the keyswitch 13. The keyswitch comprises a base plate 12, a membrane circuit board 14 installed on the base plate 12, and a rubber sheet 20 positioned on the membrane circuit board 14. The rubber sheet 20 has a plurality of upwardly protruding rubber domes 22 on its upper side 23, and three penetrating holes 31 set up around each of the rubber domes 22. The membrane circuit board 14 has a plurality of pressure sensors 16 for generating key-pressing signals and three penetrating holes 30 installed around each of the pressure sensors 16. The base plate 12 has a plurality of holding legs 32 protruding upwardly through the penetrating holes 30, 31 on the membrane circuit board 14 and the rubber sheet 20. In order to reduce the thickness of the computer keyswitch, the thickness of the rubber sheet is often reduced, causing a weakened structure of straps 21 around each rubber dome 22 and thus distortions of the straps 21. This will then generate position errors between the rubber domes 22 and the pressure sensors 16.

Please refer to FIGS. 3 and 4. FIG. 3 is a component diagram of a keyswitch 37 of another computer keyswitch. FIG. 4 is a cross-sectional view of the keyswitch 37. The computer keyswitch comprises a base plate 11, a membrane circuit board 17 installed on the base plate 11, a plurality of stand-alone rubber domes 23 installed on the membrane circuit board 17, and a plastic frame board 34 installed on the membrane circuit board 17 for fixing positions of the rubber domes 23. The membrane circuit board 17 has a plurality of pressure sensors 16 for generating key-pressing signals. The plastic frame board 34 has a plurality of penetrating holes 35 positioned corresponding to the pressure sensors 16. When the plastic frame board 34 is installed on the membrane circuit board 17, the rubber domes 23 on the pressure sensors 16 will penetrate through the penetrating holes 35 of the plastic frame board 34, and edges 23*a* of the rubber domes 23 will be clamped between the plastic frame board 34 and the membrane circuit board 17. Using the plastic frame board 34 to fix the positions of the rubber domes 23 has the drawback of increasing the thickness of the computer keyswitch.

SUMMARY OF THE INVENTION

It is therefore an objective of the present invention to provide a computer keyswitch with accurately positioned rubber domes and a reduced thickness to solve the above mentioned problems.

In a preferred embodiment, the present invention provides a computer keyswitch with accurately positioned rubber domes. The computer keyswitch includes a base plate, a membrane circuit board installed on the base plate having a plurality of pressure sensors and a plurality of penetrating holes installed around each of the pressure sensors, a rubber sheet positioned on the membrane circuit board having a plurality of upwardly protruding rubber domes on its upper side above the pressure sensors and a plurality of penetrating holes around each of the rubber domes, a plurality of keycaps, and a plurality of connecting devices each connected between a keycap and the base plate through the penetrating holes of the rubber sheet and the membrane circuit board. The membrane circuit board further includes a plurality of fastening holes installed among the pressure sensors, and the rubber sheet further includes a plurality of corresponding rubber pegs installed on its lower side for engaging the fastening holes of the membrane circuit board in order to accurately position the rubber domes of the rubber sheet on the pressure sensors of the membrane circuit board.

It is an advantage of the present invention that the rubber domes can be accurately positioned on the pressure sensors and the thickness of the computer keyswitch can be reduced.

These and other objectives of the present invention will no doubt become obvious to those of ordinary skill in the art after reading the following detailed description of the preferred embodiment which is illustrated in the various figures and drawings.

DETAILED DESCRIPTION OF THE PREFERRED EMBODIMENT

Figure 1:
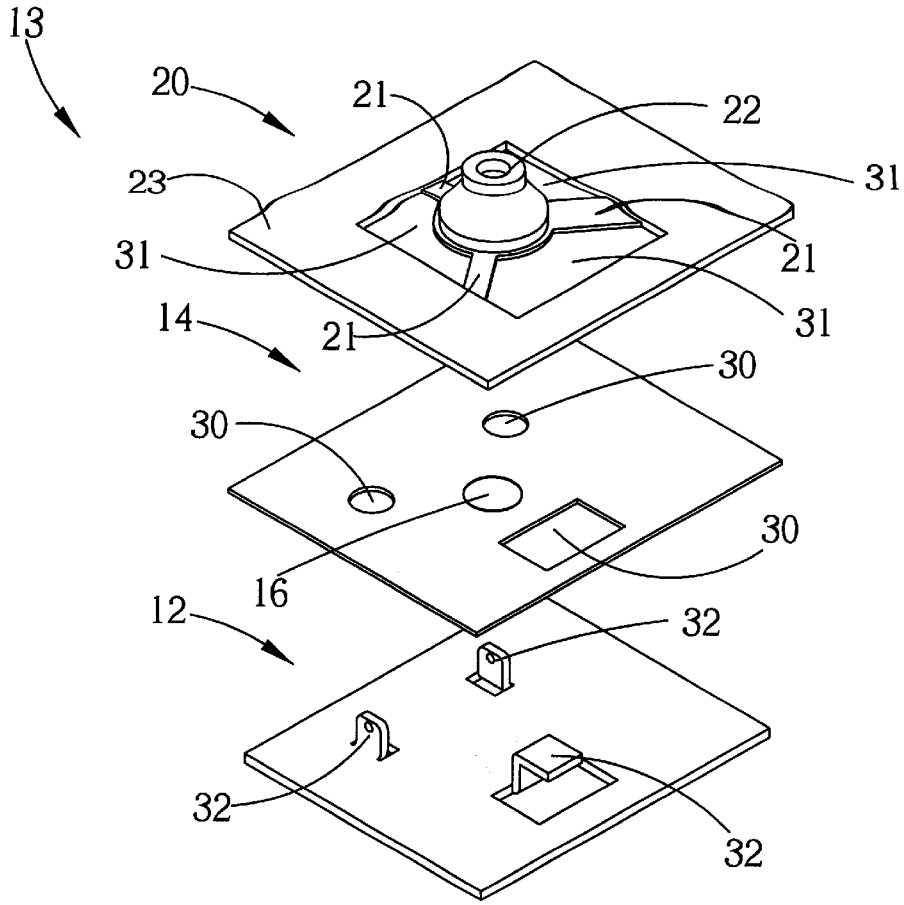
Fig. 1 Prior art
FIG. 1 is a component diagram of a prior art computer keyswitch.
Figure 2:
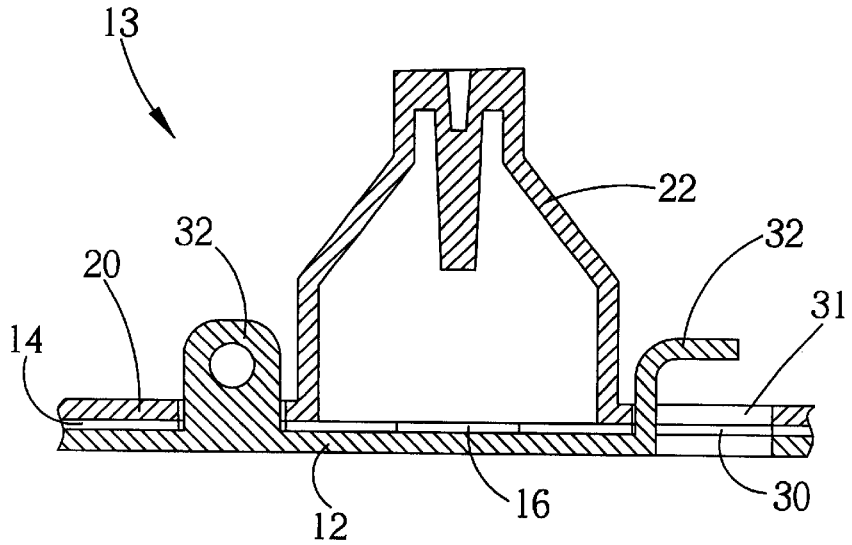
Fig. 2 Prior art
FIG. 2 is a cross-sectional view of the keyswitch in FIG. 1.
Figure 3:
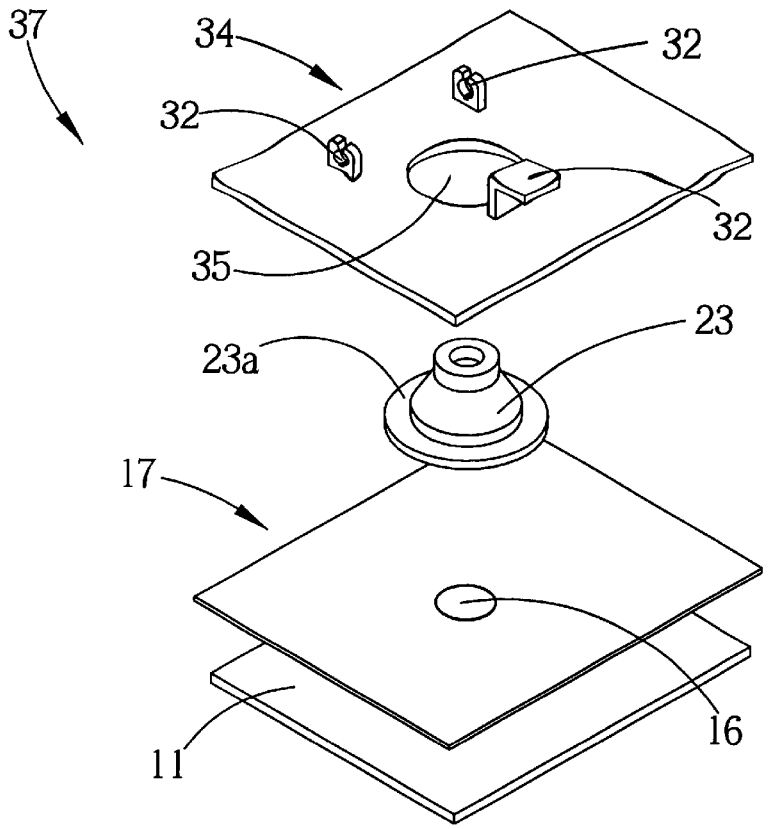
Fig. 3 Prior art
FIG. 3 is a component diagram of another prior art computer keyswitch.
Figure 4:
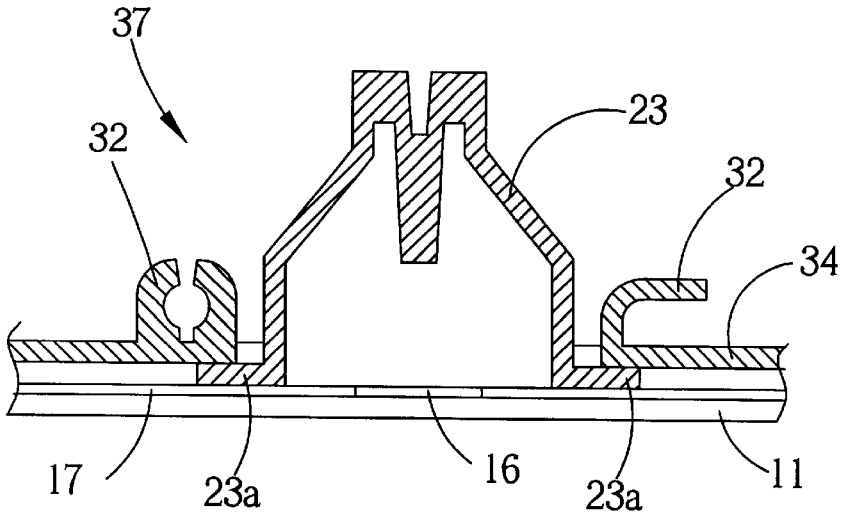
Fig. 4 Prior art
FIG. 4 is a cross-sectional view of the keyswitch in FIG. 3.
Figure 5:
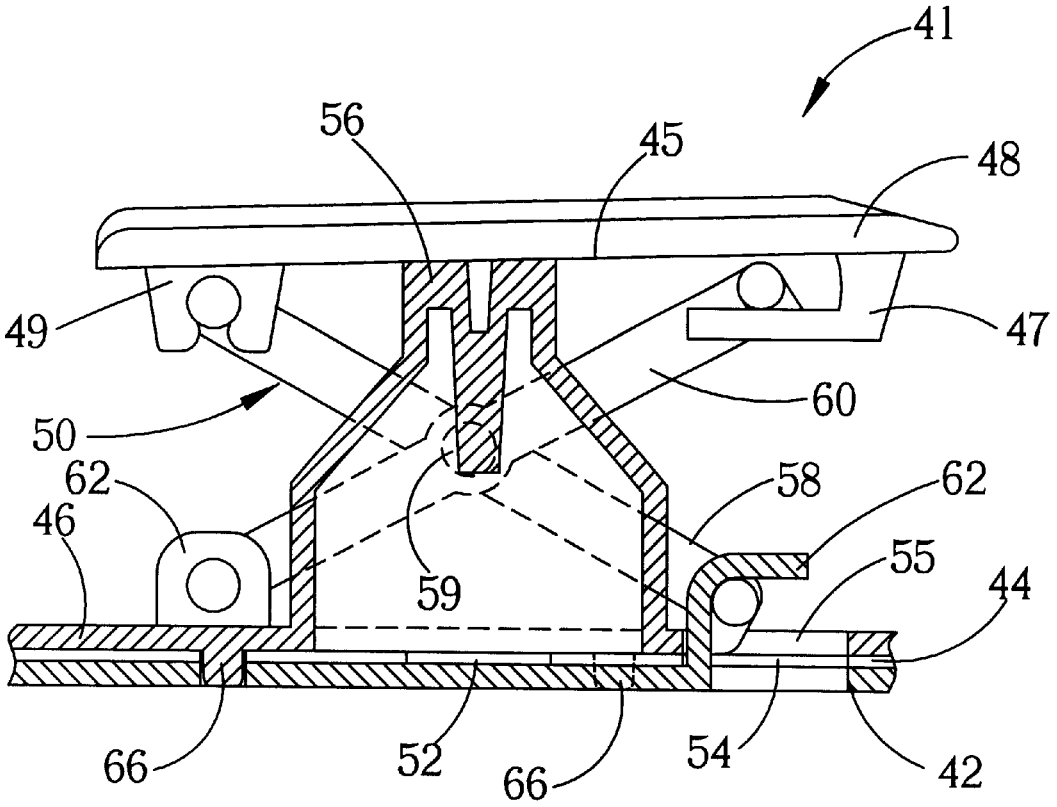
FIG. 5 is a cross-sectional view of a computer keyswitch according to the present invention.
Figure 6:
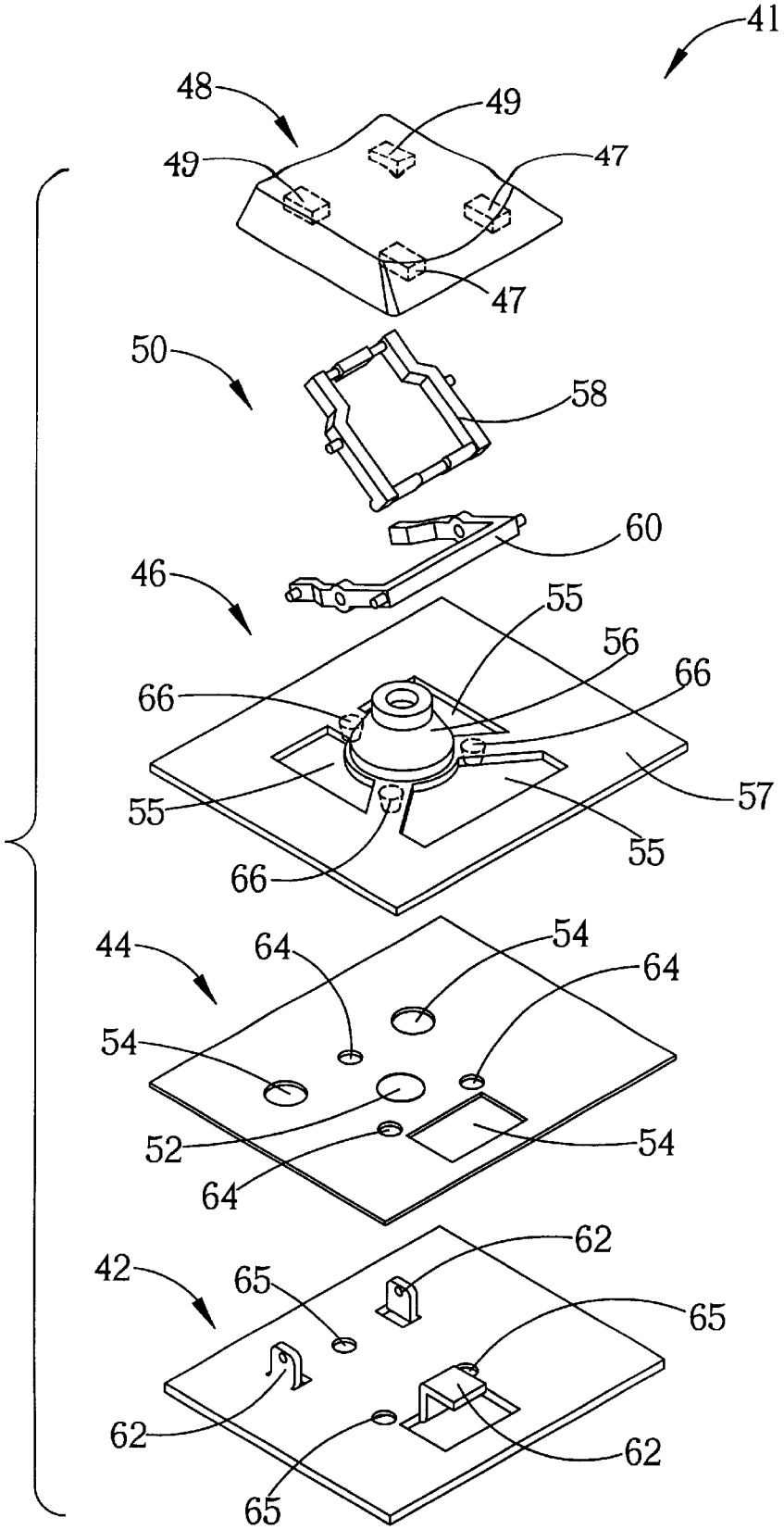
FIG. 6 is a component diagram of the keyswitch in FIG. 5.

Please refer to FIGS. 5 and 6. FIG. 5 is a cross-sectional view of a computer keyswitch 41 according to the present invention. FIG. 6 is a component diagram of the keyswitch 41. The computer keyswitch 41 comprises a base plate 42, a membrane circuit board 44 installed on the base plate 42, a rubber sheet 46 positioned on the membrane circuit board 44, a keycap 48, and a connecting devices 50 movably mounted between the keycap 48 and the base plate 42.

The membrane circuit board 44 has a pressure sensor 52 for generating a key-pressing signal and three membrane penetrating holes 54 installed around the pressure sensor 52. The rubber sheet 46 has a upwardly protruding rubber dome 56 formed on its upper side 57 for elastically supporting the keycap 48. The rubber dome 56 is positioned above the pressure sensor 52 of the membrane circuit board 44. The rubber sheet 46 has three rubber penetrating holes 55 around the rubber dome 56.

The keycap 48 has two sliding slots 47 and two bearing portions 49 at a bottom surface 45 thereof. The base plate 42 is a thin metal plate with three holding legs 62 protruding upwardly through the corresponding membrane penetrating holes 54, rubber penetrating holes 55 in the membrane circuit board 44 and the rubber sheet 46. The connecting device 50 comprises two connecting pieces 58, 60 pivotally coupled to each other at their center portions 59. The protruding pivot formed on the center potion 59 of the connecting device 58 is coupled to the receiving slot formed on the center portion 59 of the connecting device 50. Upper ends of the connecting pieces 58, 60 are connected with the two bearing portions 49 and the two sliding slots 47 at the bottom surface 45 of the keycap 48 respectively. Lower ends of the connecting pieces 58, 60 are connected to the holding legs 62 formed on the base plate 42.

Figure 7:
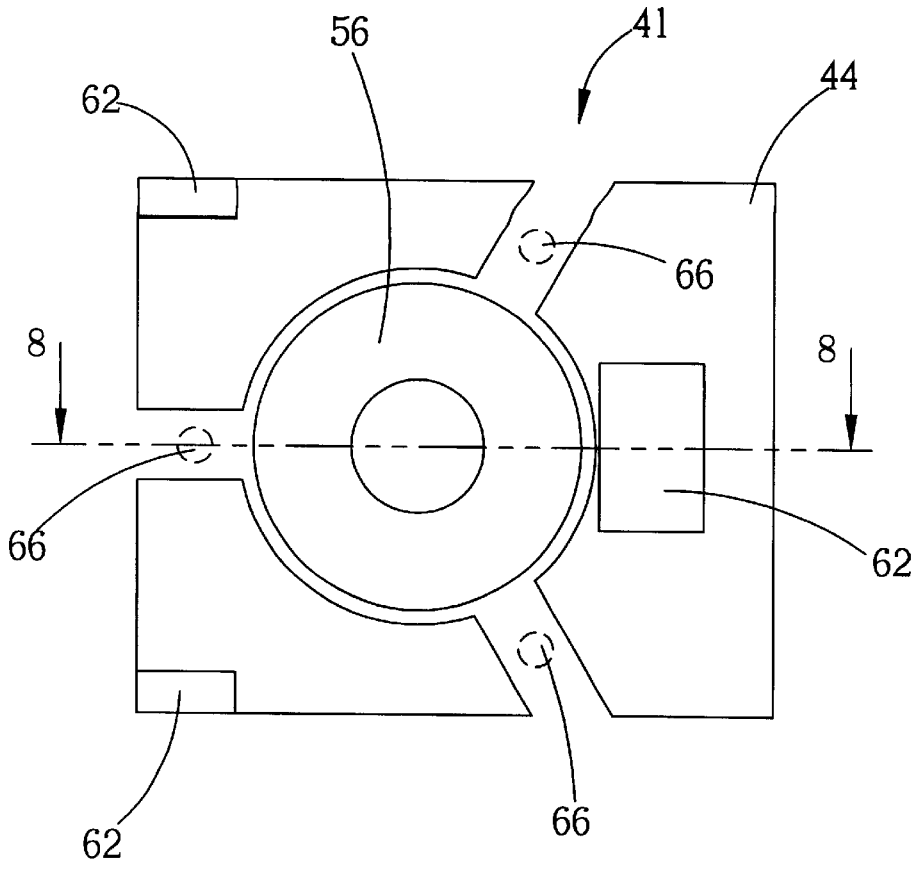
FIG. 7 is a top view of the keyswitch in FIG. 5.
Figure 8:
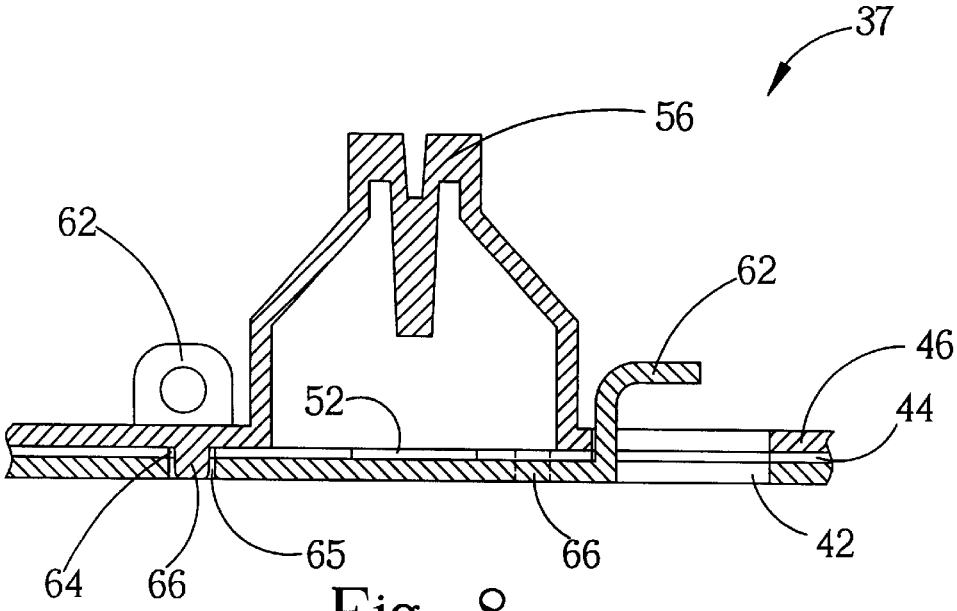
FIG. 8 is a cross-sectional view of the keyswitch along line 8—8 in FIG.7.

As shown in FIGS. 7 and 8., FIG. 7 is a top view of the keyswitch 41, and FIG. 8 is a cross-sectional view of the keyswitch 41 along line 8—8 in FIG. 7. The membrane circuit board 44 comprises three membrane fastening holes 64 around the pressure sensor 52. Under each of the membrane fastening holes 64, one corresponding plate fastening hole 65 is formed on the base plate 42. Around the rubber dome 56, three rubber pegs 66 formed on the bottom surface of the rubber sheet 46 for inserting into the corresponding membrane fastening holes 64, and the plate fastening holes 65. Therefore, the rubber sheet 46 and the rubber domes 56 can be accurately positioned around the pressure sensor 52 of the membrane circuit board 44.

Figure 9:
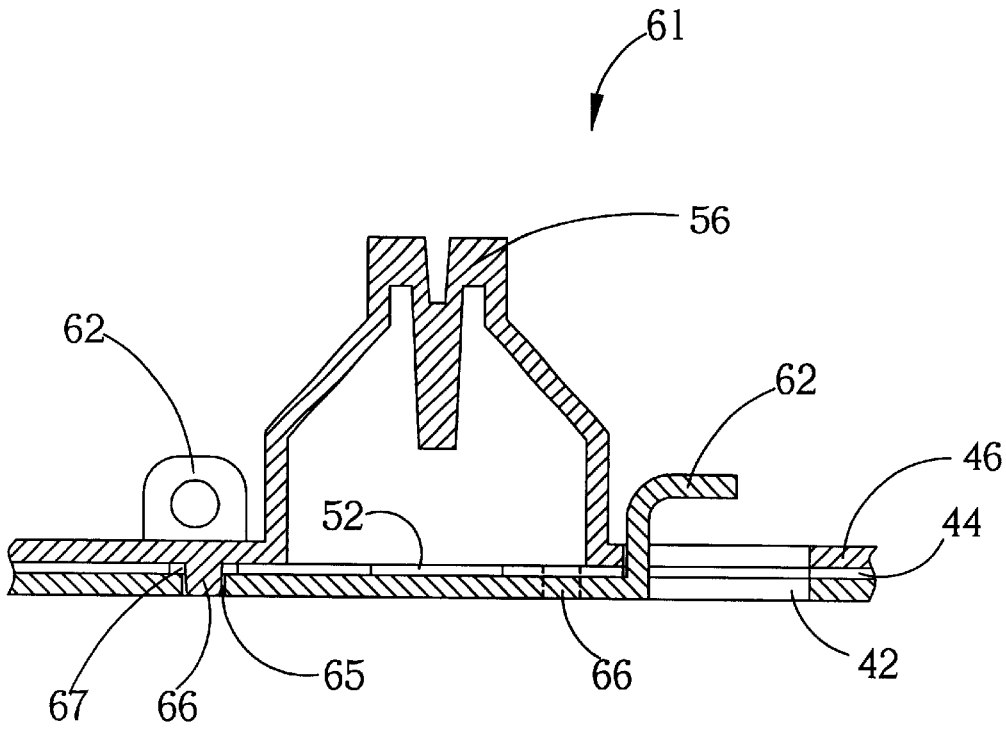
FIG. 9 shows another computer keyswitch according to the present invention.
Figure 10:
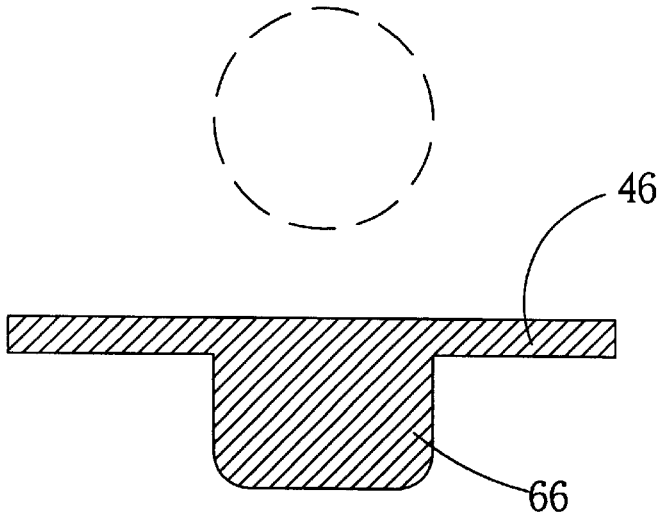
FIGS. 10 to 13 show four different rubber pegs according to the present invention.
Figure 11:
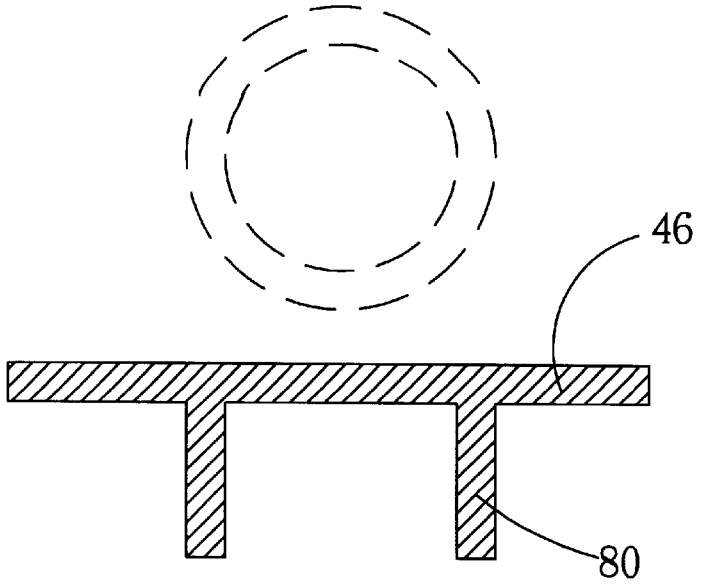
Figure 12:
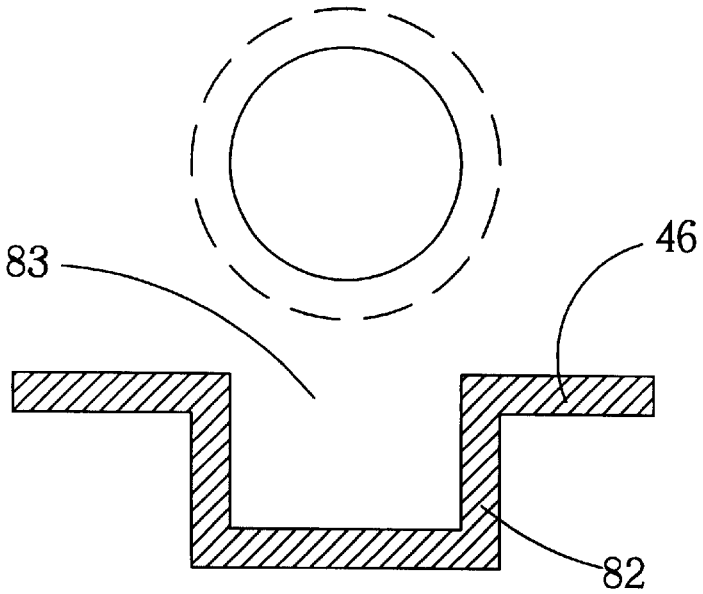
Figure 13:
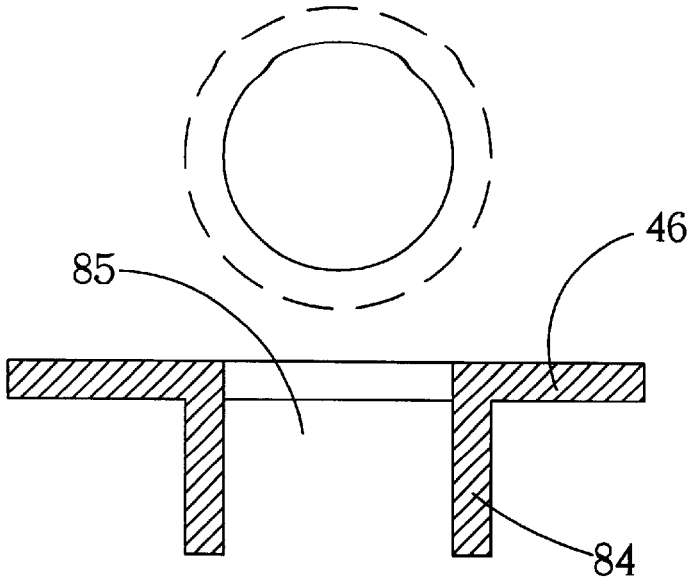

Please refer to FIG. 9. FIG. 9 shows another computer keyswitch 61 according to the present invention. The diameter of each membrane fastening hole 67 in the membrane circuit board 44 is greater than that of the corresponding plate fastening hole 65 in the base plate 42. The three rubber pegs 66 around each rubber dome 56 are fastened to the corresponding plate fastening holes 65 in the base plate 42 through the membrane fastening holes 67 in the membrane circuit board 44. In this arrangement, the rubber peg 66 can be more easily inserted into the corresponding membrane fastening hole 64, but the rubber sheet 46 and the rubber domes 56 can also be accurately positioned on the pressure sensors 52 of the membrane circuit board 44.

Please refer to FIGS. 10 to 13. FIGS. 10 to 13 show four different rubber pegs 66, 80, 82, 84. The rubber peg 66 in FIG. 10 has a solid structure. The rubber peg 80 in FIG. 11 has a cylindrical shape with an open bottom and a closed top. The rubber peg 82 in FIG. 12 has a cylindrical shape with a closed bottom and an open top that forms a recess 83 at its lower end. The rubber peg 84 in FIG. 13 has a downwardly protruding ring-shaped structure that is open-ended.

Figure 14:
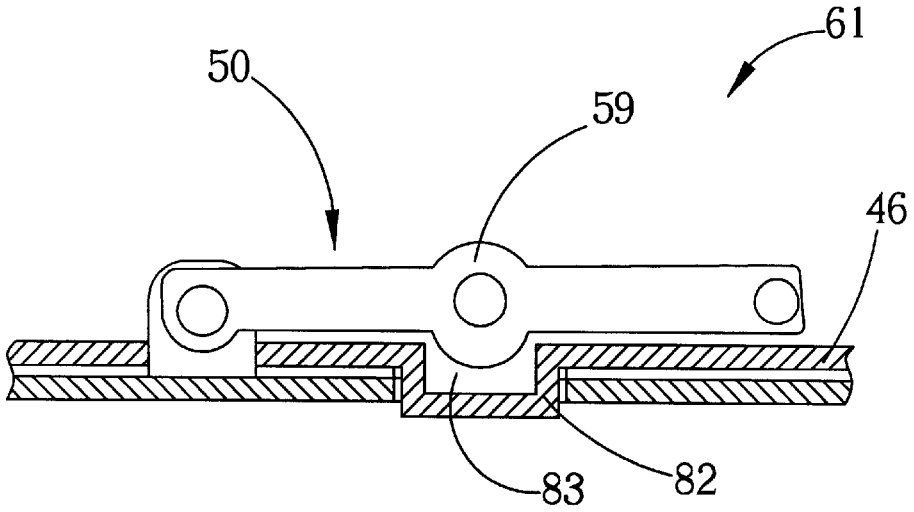
FIGS. 14 and 15 are side views of the rubber pegs in FIG. 12 incorporated into the keyswitch in FIG. 9.
Figure 15:
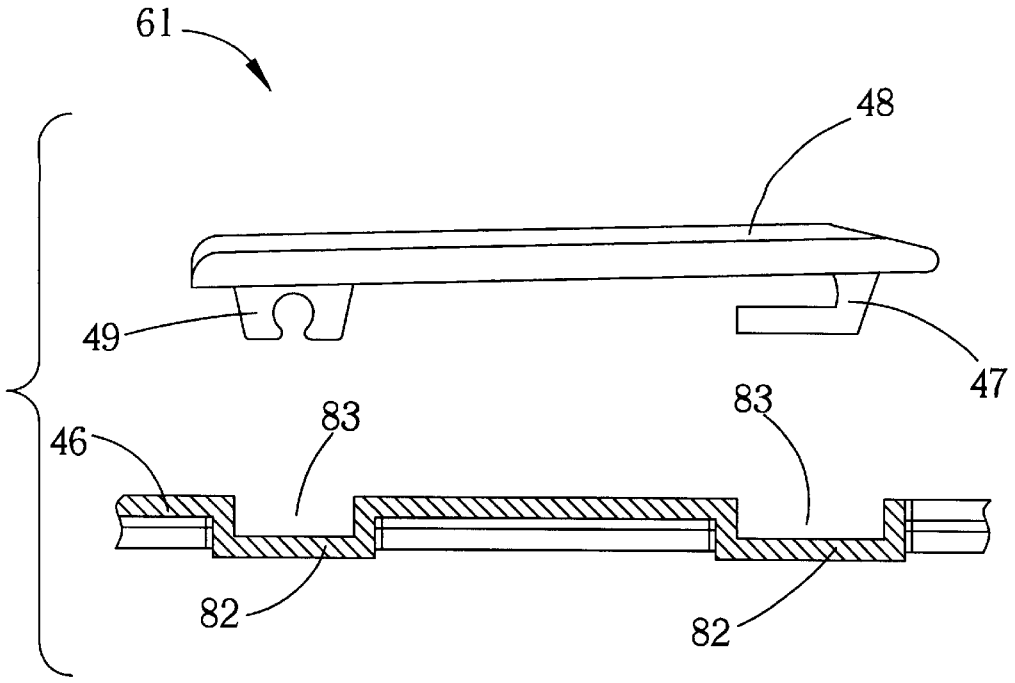

Please refer to FIGS. 14 and 15. FIGS. 14 and 15 are side views of the rubber pegs 82 incorporated into the keyswitch 61. The rubber pegs 82 can not only accurately position the rubber domes 56 on the pressure sensors 52, but can also reduce the overall thickness of the computer keyswitch 61. As shown in FIG. 14, the recess 83 of the rubber peg 82 is used to accommodate the center portion 59 of the connecting device 50. As shown in FIG. 15, the recesses 83 of the rubber pegs 82 are used to accommodate the sliding slots 47 and bearing portions 49 at the bottom surface 45 of the keycap 48. Moreover, if the the rubber pegs 82 are replaced by the rubber pegs 84, then the overall thickness of the computer keyswitch 61 can be reduced much more.

In the computer keyswitch 61, the rubber sheet 46 has three rubber pegs 66 formed on its bottom surface around the rubber dome 56 for accurately positioning the rubber sheet 46 and rubber domes 56 above the pressure sensor 52, preventing cumulative position errors between the rubber dome 56 and the pressure sensor 52. Further, rubber pegs can have different shapes. The recess 83 of the rubber peg 82 and the empty space 85 of the rubber peg 84 can be used to accommodate the center portion 59 of the connecting device 50 or the sliding slots 47 and bearing portions 49 at the bottom surface 45 of the keycap 48, reducing the overall thickness of the computer keyswitch 61.

Figure 16:
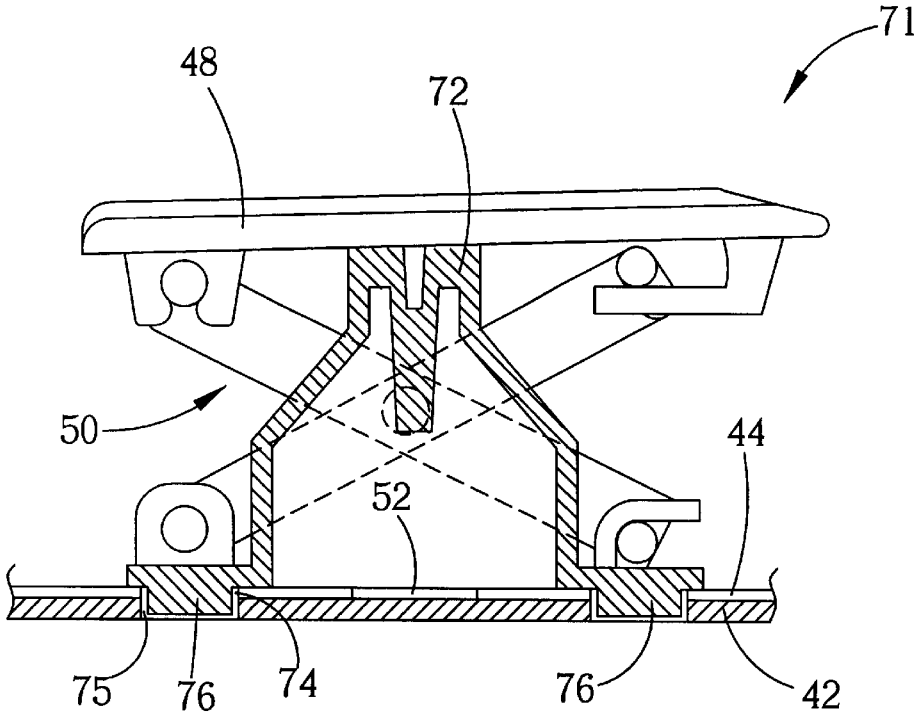
FIG. 16 is a cross-sectional view of another computer keyswitch according to the present invention.
Figure 17:
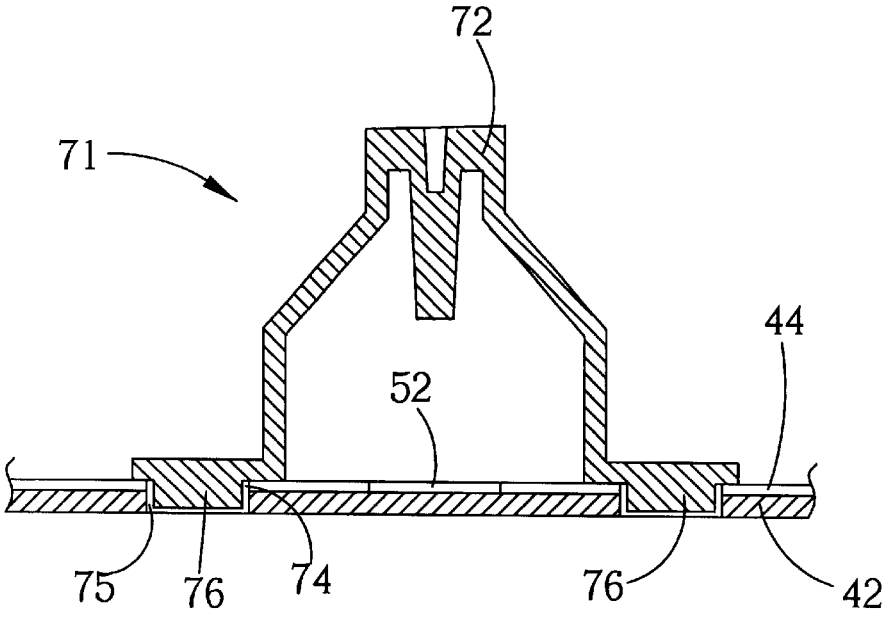
FIG. 17 shows a part of the keyswitch in FIG. 16.
Figure 18:
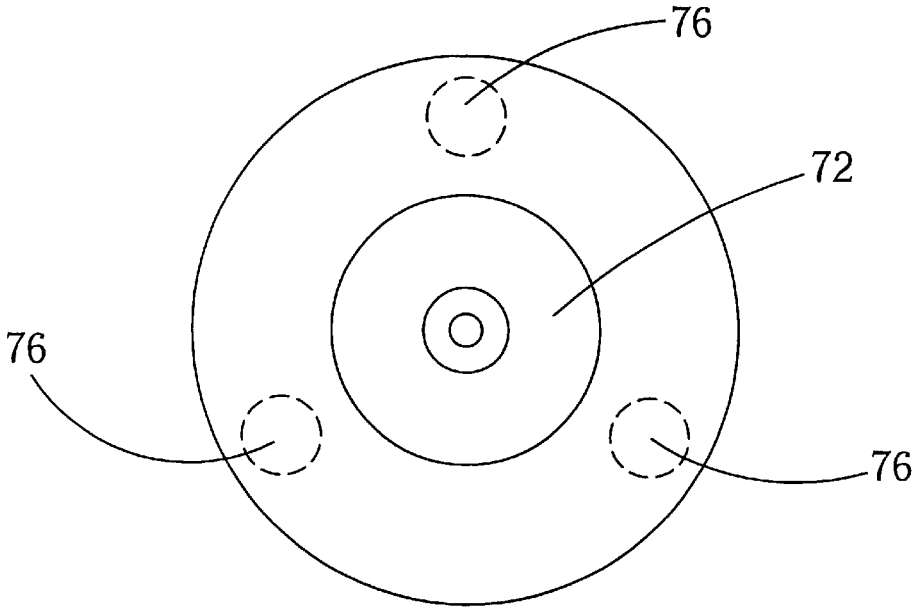
FIG. 18 is a top view of the rubber dome in FIG. 16.

Please refer to FIGS. 16 to 18. FIG. 16 is a cross-sectional view of another computer keyswitch 71 according to the present invention. FIG. 17 shows a part of the keyswitch 71. FIG. 18 is a top view of the rubber dome 72 in FIG. 16. Unlike the keyswitch 41 shown in FIG. 6, a plurality of rubber domes 56 can be formed on one rubber sheet 46 and linked to each other, the rubber dome 72 is of a stand-alone type.

The computer keyswitch 71 comprises a base plate 42, a membrane circuit board 44, a rubber dome 72, a keycap 48, and a connecting device 50. The membrane circuit board 44 has three membrane fastening holes 74 around the pressure sensor 52. Under each of the membrane fastening holes 74, one corresponding plate fastening hole 75 is formed on the base plate 42. Three rubber pegs 76 are formed on the bottom surface along the circumference of the rubber dome 72 for inserting into the corresponding membrane fastening hole 74, and plate fastening hole 75 around the pressure sensor 52 under the rubber dome 72 in order to accurately position the rubber dome 72 on top of the pressure sensor 52.

Figure 19:
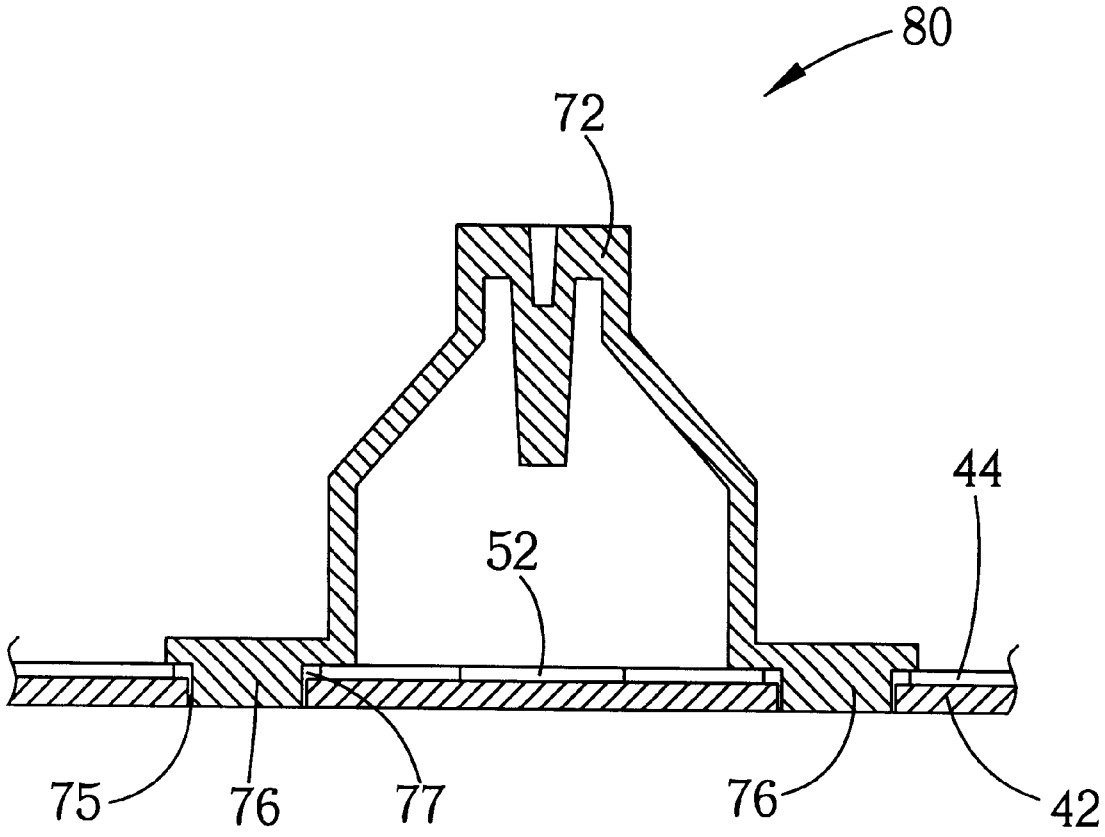
FIG. 19 shows another keyswitch according to the present invention.

Please refer to FIG. 19, which shows a different keyswitch 80 according to the present invention. In this design, the membrane fastening holes 77 of the membrane circuit board 44 have a diameter greater than that of plate fastening holes 75 of the base plate 42. The rubber pegs 76 are fixed within the plate fastening holes 75 of the base plate 42 through the membrane fastening holes 77 of the membrane circuit board 44, therefore accurately positioning each rubber dome 72 above the corresponding pressure sensor 52 of the membrane circuit board 44.

Compared with prior art computer keyswitch, the computer keyswitch of the present invention use the rubber pegs 66, 76 of the rubber domes 56, 72 to accurately position the rubber domes above the pressure sensors 52 of the membrane circuit board 44, thus preventing cumulative position errors without increasing the thicknesses of the computer keyswitch. In addition, the rubber domes 72 are accurately positioned above each pressure sensor 52 without having their edges clamped by an additional plastic frame board 34 (FIG. 6), reducing the thickness of the computer keyswitch.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A computer keyswitch comprising:

a keycap;

a base plate;

a membrane circuit board positioned above the base plate having a pressure sensor for generating a key-pressing signal, a plurality of membrane penetrating holes formed around the pressure sensor, and a membrane fastening hole;

a rubber sheet positioned on the membrane circuit board having an upwardly protruding rubber dome on an upper surface of the rubber sheet for elastically supporting the keycap upwardly, and a plurality of straps and rubber penetrating holes formed around the rubber dome wherein the rubber dome is positioned above the pressure sensor of the membrane circuit board;

a rubber peg formed on a bottom surface of one of the straps of the rubber sheet; and a connecting device having an upper end and a lower end wherein the upper end of the connecting device is connected to a bottom surface of the keycap, while the lower end of the connecting device is installed on the base plate through the rubber penetrating holes and the membrane penetrating holes to fasten the keycap to the base plate in an up-and-down movable manner;

wherein the rubber peg is inserted into the membrane fastening hole in order to accurately position the rubber dome of the rubber sheet above the pressure sensor of the membrane circuit board.

2. The computer keyswitch of claim 1 wherein the connecting device further comprises two connecting pieces pivotally coupled to each other at center portions of the two connecting pieces wherein the upper ends of the two connecting pieces are connected to the bottom surface of the keycap and the lower ends of the two connecting pieces are connected to the base plate through the rubber penetrating holes and the membrane penetrating holes.

3. The computer keyswitch of claim 2 wherein the base plate is a thin metal plate with a plurality of holding legs protruding upwardly through the rubber penetrating holes and the membrane penetrating holes around the pressure sensor wherein the lower ends of the two connecting pieces of the connecting device are connected to the holding legs.

4. The computer keyswitch of claim 1 wherein the base plate further comprises a plate fastening hole formed under the membrane fastening hole, and the rubber peg is fastened to both the membrane fastening hole and the plate fastening hole.

5. The computer keyswitch of claim 4 wherein a size of the membrane fastening hole is greater than a size of the plate fastening hole.

6. The computer keyswitch of claim 1 wherein the rubber peg is formed along a circumference of a bottom surface of the rubber dome.

7. The computer keyswitch of claim 1 wherein the rubber peg has a solid structure.

8. The computer keyswitch of claim 1 wherein the rubber peg has a cylindrical shape.

9. The computer keyswitch of claim 1 wherein the rubber peg comprises a recess on a lower end of the rubber peg.

10. The computer keyswitch of claim 1 wherein the rubber peg comprises a downwardly protruding ring-shaped structure.

11. A computer keyswitch comprising:

a keycap;

a base plate having a plate fastening hole;

a membrane circuit board positioned above the base plate having a pressure sensor for generating a key-pressing signal, a plurality of membrane penetrating holes formed around the pressure sensor, and a membrane fastening hole formed above the plate fastening hole, the membrane fastening hole having a size greater than a size of the plate fastening hole;

an upwardly protruding rubber dome positioned above the pressure sensor of the membrane circuit board for elastically supporting the keycap upwardly;

a rubber peg formed on a bottom surface of the rubber dome; and a connecting device having an upper end and a lower end wherein the upper end of the connecting device is connected to a bottom surface of the keycap, while the lower end of the connecting device is installed on the base plate through the membrane penetrating holes to fasten the keycap to the base plate in an up-and-down movable manner;

wherein the rubber peg is inserted into the membrane fastening hole and the plate fastening hole in order to accurately position the rubber dome above the pressure sensor of the membrane circuit board.

12. The computer keyswitch of claim 11 wherein the connecting device further comprises two connecting pieces pivotally coupled to each other at center portions of the two connecting pieces wherein the upper ends of the two connecting pieces are connected to the bottom surface of the keycap and the lower ends of the two connecting pieces are connected to the base plate through the membrane penetrating holes.

13. The computer keyswitch of claim 12 wherein the base plate is a thin metal plate with a plurality of holding legs protruding upwardly through the membrane penetrating holes around the pressure sensor wherein the lower ends of the two connecting pieces of the connecting device are connected to the holding legs.

14. The computer keyswitch of claim 11 wherein the rubber peg is formed along a circumference of a bottom surface of the rubber dome.

15. The computer keyswitch of claim 11 wherein the rubber peg has a solid structure.

16. The computer keyswitch of claim 11 wherein the rubber peg has a cylindrical shape.

17. A computer keyswitch comprising:

a keycap;

a base plate;

a membrane circuit board positioned above the base plate having a pressure sensor for generating a key-pressing signal, a plurality of membrane penetrating holes formed around the pressure sensor, and a membrane fastening hole;

an upwardly protruding rubber dome positioned above the pressure sensor of the membrane circuit board for elastically supporting the keycap upwardly;

a rubber peg formed on a bottom surface of the rubber dome, the rubber peg having a recess on a lower end of the rubber peg; and a connecting device having an upper end and a lower end wherein the upper end of the connecting device is connected to a bottom surface of the keycap, while the lower end of the connecting device is installed on the base plate through the membrane penetrating holes to fasten the keycap to the base plate in an up-and-down movable manner;

wherein the rubber peg is inserted into the membrane fastening hole in order to accurately position the rubber dome above the pressure sensor of the membrane circuit board.

18. A computer keyswitch comprising:

a keycap;

a base plate;

a membrane circuit board positioned above the base plate having a pressure sensor for generating a key-pressing signal, a plurality of membrane penetrating holes formed around the pressure sensor, and a membrane fastening hole;

an upwardly protruding rubber dome positioned above the pressure sensor of the membrane circuit board for elastically supporting the keycap upwardly;

a rubber peg formed on a bottom surface of the rubber dome, the rubber peg having a downwardly protruding ring-shaped structure; and a connecting device having an upper end and a lower end wherein the upper end of the connecting device is connected to a bottom surface of the keycap, while the lower end of the connecting device is installed on the base plate through the membrane penetrating holes to fasten the keycap to the base plate in an up-and-down movable manner;

wherein the rubber peg is inserted into the membrane fastening hole in order to accurately position the rubber dome above the pressure sensor of the membrane circuit board.

* * * * *

UNITED STATES PATENT AND TRADEMARK OFFICE

CERTIFICATE OF CORRECTION

PATENT NO. : 6,288,353 B1
DATED : September 11, 2001
INVENTOR(S) : Chih-Hsiang Chiang It is certified that error appears in the above-identified patent and that said Letters Patent is hereby corrected as shown below:

Title page,
Item [73], should read as follows:
-- Darfon Electronics Corp. --

Signed and Sealed this

Thirtieth Day of April, 2002

*Attest:*

*Attesting Officer*

JAMES E. ROGAN
*Director of the United States Patent and Trademark Office*